United States Patent [19]

Vicard

[11] 4,026,475

[45] May 31, 1977

[54] DEVICES FOR ATOMIZING LIQUIDS

[75] Inventor: Jean-Francois Vicard, Lyon, France

[73] Assignee: Societe Lab, Villeurbanne, France

[22] Filed: Mar. 15, 1976

[21] Appl. No.: 666,537

[30] Foreign Application Priority Data

Mar. 21, 1975 France ..... 75.09566

[52] U.S. Cl. ..... 239/468; 239/486

[51] Int. Cl.[2] ..... B05B 1/34

[58] Field of Search ..... 239/463, 468–471, 239/474, 475, 486, 214.21

[56] References Cited

UNITED STATES PATENTS

| | | | |
|---|---|---|---|
| 1,511,940 | 10/1924 | Boyer | 239/468 |
| 1,730,708 | 10/1929 | Wittenberg | 239/471 |
| 2,161,016 | 6/1939 | Carr | 239/468 |

FOREIGN PATENTS OR APPLICATIONS

| | | | |
|---|---|---|---|
| 527,494 | 4/1954 | Belgium | 239/468 |

*Primary Examiner*—Robert S. Ward, Jr.
*Attorney, Agent, or Firm*—Dowell & Dowell

[57] ABSTRACT

An atomizer for liquids having an annular body part with a circumferential groove in its inner periphery, and an inlet for injecting liquid tangentially into the groove whose depth decreases gradually away from the inlet is provided with a member which directs solid particles travelling along the groove with the liquid away from the groove to prevent them circulating in the groove. The member may be a curved tongue which forms an extension of the bottom wall of the groove at a position where the groove ends and which directs the particles inwardly and axially away from the groove.

7 Claims, 5 Drawing Figures

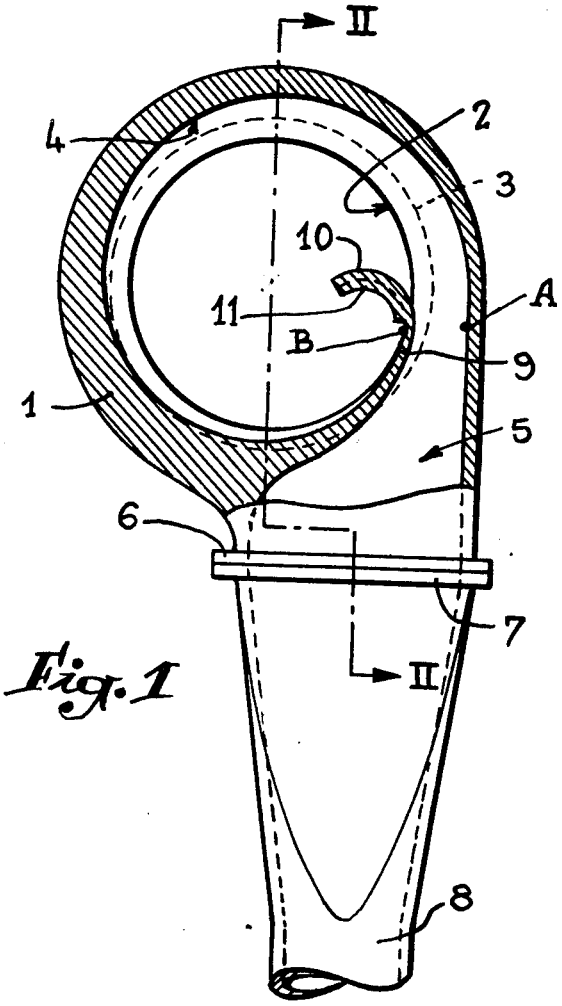
Fig. 1
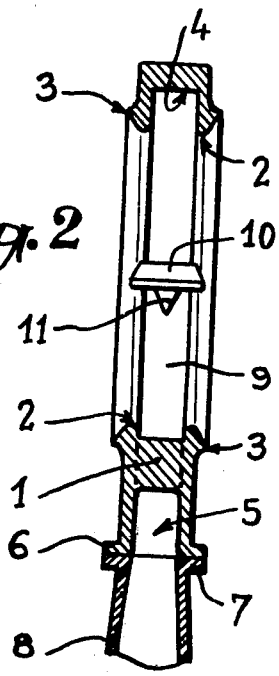
Fig. 2
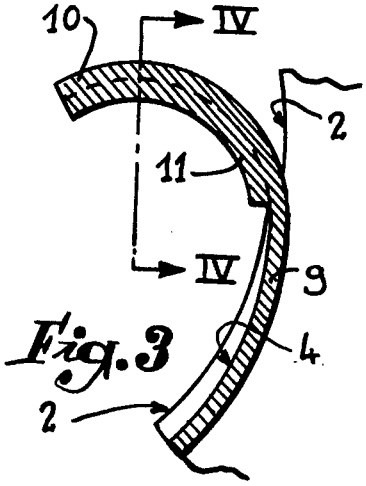
Fig. 3
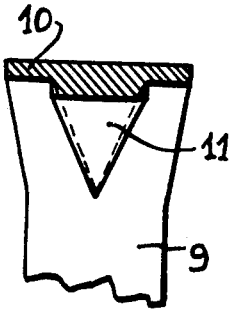
Fig. 4
Fig. 5
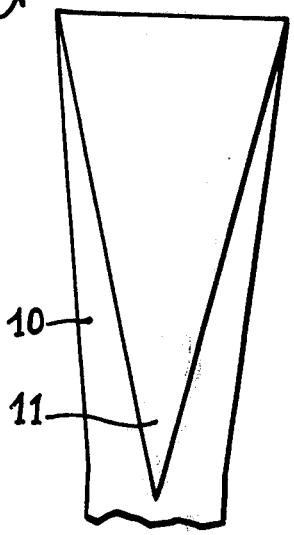

DEVICES FOR ATOMIZING LIQUIDS

This invention relates to a device for atomizing liquids.

In a known method of atomizing a liquid, the liquid is injected tangentially into an annular groove formed on the inside of an atomiser. The liquid flows at a very high velocity around the groove so that it overflows from it in the form of one or two conical sheets of very fine droplets. If the profile of the groove is symmetrical in a transverse plane two symmetric sheets are formed whereas, if the profile is asymmetrical, for example if the atomiser has a continuous wall at one side of the groove, a single sheet is obtained.

In order to ensure uniform atomization over the whole extent of the groove it preferably has a depth which decreases gradually from the point of liquid injection so that the groove terminates just upstream of the injection point.

When this method is used with liquids containing heavy particles, as a result of the centrifugal force, these particles tend to concentrate against the bottom wall of the groove, and can upset the uniform atomization. In addition, if the particles are abraisive they can wear away the material of the atomizer itself and put it out of action.

In accordance with the invention there is provided a device for atomizing liquids comprising a body with an internal, generally annular groove therein, inlet means in the body for injecting liquid tangentially into the groove to flow along the groove and overflow from an edge thereof to form a conical spray of fine liquid droplets, and deflector means in the body for deflecting solid particles travelling along the groove away from the groove thereby to prevent the particles completing more than one circuit around the groove.

With a device of this construction any heavy particles suspended in the liquid cannot accumulate in the bottom of the groove and are instead driven out of it.

In a preferred embodiment the depth of the groove decreases gradually from inlet means eventually becoming zero after substantially 360° extent, and the deflector means comprises a tonque which forms an extension of the bottom wall of the groove. Advantageously the tonque is given a spiral form and has a projection for deflecting the particles axially.

The preferred embodiment of the invention is described in detail below by way of example with reference to the accompanying drawing, in which:

FIG. 1 a plan view, shown partly in section, of an atomizer in accordance with the invention;

FIG. 2 is a cross-section along the line II—II of FIG. 1;

FIG. 3 shows on a larger scale the deflector tonque and its projection of the atomizer illustrated in FIG. 1;

FIG. 4 is a section along the line IV—IV of FIG. 3; and

FIG. 5 is a developement of the active face of the tonque.

The atomizer shown in the drawing comprises a hollow annular body 1 in the form of a flat cylinder open across both its end faces and symmetrical with respect to its transverse mid-plane. Each of the axial openings 2 diverges outwardly in the manner of a conical nozzle and terminates in a sharp edge 3.

On the inside periphery of the body 1 is formed a groove 4 whose bottom wall extends along a spiral path so that the depth of the groove reduces gradually from maximum at a point A finally reaching zero at a point B located at about 360° from point A. The deepest portion of the groove 4 is connected with an inlet chamber 5 formed in a part of the body integral with a flange 6, to which is attached a corresponding flange 7 provided on the flattened end of a liquid feed-pipe 8.

At the point B a wall 9 which separates the bottom of the groove from the inlet chamber 5 is extended in the form of a tonque 10 which is curled inwardly at a radius much smaller than the smallest radius of the openings 2. The width of the tonque increases towards its free end as in clearly shown in FIGS. 2, 4 and 5. On the concave face of the tonque 10 is provided a projection 11 shaped as an isosceles triangle with a small apex angle, the base of the triangle coinciding with the free end of the tonque, whilst the apex is located substantially at the point B.

Liquid is supplied under pressure through the pipe 8 and is injected tangentially at high speed into the groove 4 at the point A where the groove has the maximum depth and consequently the maximum cross-section since its width is constant. As the liquid advances along the groove the depth of the latter reduces and consequently some of the liquid overflows out through the openings 2 forming two oppositely directed conical sheets of liquid which are divided into very fine droplets along the edges 3 under the action of the centrifugal force. Due to the spiral path of the bottom of the groove the atomization thus obtained is uniform round the whole periphery of the device.

If the liquid contains dense impurities, such as solid mineral particles, these concentrate under the centrifugal force against the bottom of the groove 4. Because of the decreasing depth of the groove some of these solid impurities overflow with the liquid and are carried away with the conical sheets or are driven outwardly by the centrifugal force. In the absence of the tonque 10, however, a significant proportion of the solid impurities would fall back into the deepest portion of the groove so that a relatively thick layer of solid particles would be formed in the groove and quickly cause the groove 4 to be damaged through abrasion eventually making the atomizer unusable. It should be noted that any significant erosion in the region of the point B would eliminate the zone of zero depth and would define a connecting channel which tends to retain the solid particles.

The tonque 10 ensures that solid particles and other dense impurities which reach the point B are deflected away from the groove to prevent them from falling back into the groove 4 immediately downstream of the point A. In addition the projection 11 imparts an axial movement to the solid particles to discharge them through the openings 2.

It is moreover to be understood that the foregoing description has been given only by way of example, and modifications to the device are possible. For example, the atomizer could have only one opening 2, in which case the projection 11 would be arranged asymmetrically so as to deflect solid particles towards this single opening. An asymmetrical form of projection could also be employed in the above described embodiment if it were desired to exhaust the solid impurities through one of the openings. It would also be possible to replace the single tongue 10 by a channel member which leads the impurities away, for example a suitable collector. Alternatively, the tonque and its projection could be so arranged that solid impurities are projected towards a collector.

I claim:

1. In a device for atomising liquids, comprising a body having an inner surface, means defining a generally annular groove in said inner body surface, said groove having at least one circular edge, inlet means in said body for injecting liquid tangentially into said groove, and means for causing liquid flowing along said groove to overflow over said circular edge to form a conical spray of fine liquid droplets, the improvement which comprises deflector means on said body for deflecting solid particles flowing along said groove away from said groove thereby to prevent said particles completing more than one circuit around said groove.

2. The improvement of claim 1, wherein said groove extends about an axis and said deflector means is arranged to deflect solid particles generally towards said axis.

3. The improvement of claim 1, wherein said groove extends about an axis and said deflector means is arranged to deflect solid particles in a direction having a component in the directions of said axis.

4. The improvement of claim 1, wherein said groove has a bottom wall and said deflector means comprises a tonque which forms an extension of said bottom wall and is curled inwardly away from said bottom wall at a radius much smaller than the radius of said circular overflow edge of the groove.

5. The improvement of claim 3, wherein the groove has a bottom wall, and the deflector means comprises a tonque which forms an extension of said bottom wall and has an active face over which solid particles pass, and projection on the active face solid tonque deflecting solid particles axially away from said groove.

6. The improvement of claim 1, wherein collection means is provided and said deflector means is arranged to deflect solid particles to the collection means.

7. A device for atomising liquids comprising a body with an annular part having inner and outer peripheries, means defining a circumferential groove in said inner periphery, inlet means for injecting liquid substantially tangentially into said groove, said groove having at least one circular liquid overflow edge and a depth which decreases gradually away from said inlet means and is zero at a position substantially 360° from said inlet means, and a curved deflecting tonque on said body part at said 360° position for directing solid particles travelling along said groove away therefrom.

* * * * *